US005116709A

United States Patent [19]

Chen

[11] Patent Number: 5,116,709

[45] Date of Patent: * May 26, 1992

[54] ELECTROPHOTORECEPTOR USING STYRENE-MALEIC ANHYDRIDE COPOLYMER AS THE POLYMERIC BINDER

[75] Inventor: Tai J. Chen, Chutung, Taiwan

[73] Assignee: Industrial Technology Research Institute, Taiwan, Taiwan

[ * ] Notice: The portion of the term of this patent subsequent to Sep. 18, 2007 has been disclaimed.

[21] Appl. No.: 365,760

[22] Filed: Jun. 13, 1989

[51] Int. Cl.[5] ..... G03G 5/00; G03G 15/02

[52] U.S. Cl. ..... 430/96; 430/58; 430/59

[58] Field of Search ..... 430/56, 66, 67, 57, 430/58

[56] References Cited

U.S. PATENT DOCUMENTS

| | | | |
|---|---|---|---|
| 3,484,237 | 12/1969 | Shattuck et al. | 96/1.5 |
| 3,837,851 | 9/1974 | Shattuck et al. | 96/1.5 |
| 3,850,630 | 11/1974 | Regensburger et al. | 96/1.5 |
| 3,884,691 | 5/1975 | Rochlitz | 430/59 X |
| 3,895,944 | 7/1975 | Wiedemann et al. | 430/59 |
| 3,996,049 | 12/1976 | Rochlitz | 430/79 X |
| 4,006,020 | 2/1977 | Pulastri | 430/67 |
| 4,123,270 | 10/1978 | Heil et al. | 96/1.5 |
| 4,293,628 | 10/1981 | Hashimoto et al. | 430/79 |
| 4,446,217 | 5/1984 | Takasu et al. | 430/58 |
| 4,456,671 | 6/1984 | Mabuchi et al. | 430/79 |
| 4,533,612 | 8/1985 | Eilingsfeld et al. | 430/59 |
| 4,596,754 | 6/1986 | Tsutsui et al. | 430/58 |
| 4,687,721 | 8/1987 | Emoto et al. | 430/58 |
| 4,687,722 | 8/1987 | Ogawa | 430/59 |
| 4,725,520 | 2/1988 | Wiedemann et al. | 430/58 |
| 4,755,443 | 7/1988 | Suzuki et al. | 430/58 |
| 4,863,822 | 9/1989 | Fukagai et al. | 430/96 |
| 4,869,983 | 9/1989 | Bender et al. | 430/58 |
| 4,937,169 | 6/1990 | Schlosser | 430/162 |
| 4,943,502 | 7/1990 | Terrell et al. | 430/58 |
| 4,957,836 | 9/1990 | Chen | 430/59 |

FOREIGN PATENT DOCUMENTS 3210577 6/1983 Fed. Rep. of Germany .

OTHER PUBLICATIONS

1964 Encyclopedia of Polymer Science and Technology.

*Primary Examiner*—Marion E. McCamish
*Assistant Examiner*—Stephen Crossan
*Attorney, Agent, or Firm*—Scully, Scott, Murphy & Presser

[57] ABSTRACT

An electrophotoreceptor comprising a conductive substrate, a charge generation layer and a charge transport layer wherein the charge transport layer comprises a polymeric binder and a charge transport material. The improvement resides in that a copolymer of styrene and maleic acid is used as the binder in the charge transport material. The photoreceptor exhibits improved sensitivity, residual potential, durability and reproducibility.

3 Claims, No Drawings

ELECTROPHOTORECEPTOR USING STYRENE-MALEIC ANHYDRIDE COPOLYMER AS THE POLYMERIC BINDER

BACKGROUND OF THE INVENTION

Since the invention of xerography (which means "dry writing" in Greek) by C. Carlson in 1938, new facilities utilizing this technique such as xerox copier, laser printer and optical printer have provided inexpensive, convenient and fast services of copying documents and played important roles in office automation.

The focus of the xerographic technique resides in the electrophotoreceptor which is an optical element electrically insulative in darkness and becomes electrically conductive after exposure under light. The xerographic process comprises mainly five steps, namely, (1) charging, (2) photodischarging, (3) image transfer, (4) development and (5) cleaning. In order to obtain printed images of high quality, the photoreceptor must have high charge acceptance, low dark conductivity and fast photoconductivity (i.e., high sensitivity).

Photoreceptors can be classified as inorganic or organic. Typical inorganic charge generation materials include, for example, selenium, cadmium sulfide, zinc oxide and amorphous silicon. On the other hand, there are numerous organic charge generation materials, examples for which are photoconductive polymers such as poly-N-vinylcarbazole and polyvinylanthrancene, low molecular weight organic compounds such as carbazole, anthracene, oxadiazole, certain hydrazones and certain polyarylalkanes, organic pigments or dyes such as phthalocyanine pigment, azo pigment, cyanine pigment, polycyclic quinone pigment, perylene pigment, indigo dye, thioindigo dye and squaraine dye. Due to their advantages in low production cost, non-toxicity and high flexibility in utilization, organic photoreceptors (OPC) have replaced inorganic photoreceptors as the predominant photoreceptors among the commercialized photoreceptors.

The structures of photoreceptors may be classified as (1) mono layer type, such as that disclosed in U.S. Pat. No. 3,484,237, (2) functionally separated laminated type, such as those described in U.S. Pat. Nos. 3,837,851, 3,850,630, 4,123,270 and 4,293,628, and (3) microcrystalline distribution type. The functionally separated laminated layer type is the most preferred because it contains separated charge generation layer (CGL) and charge transport layer (CTL) and thus is highly flexible in the selection of materials for each layer. The characteristics and requirements may be adjusted independently in CGL or CTL. This type of photoreceptors are predominant among the present photoreceptors.

The functionally separated laminated type photoreceptors are generally composed of a conductive substrate, a charge generation layer and a charge transport layer. An optional barrier layer or an adhesive layer may be inserted between the conductive substrate and the charge generation layer. In the production of photoreceptors of this type, a charge generation layer composed of a charge generation material and a polymeric binder is coated on a conductive support and then a charge transport layer composed of a charge transport material and another polymeric binder is coated.

Organic charge transport materials have the advantages in multiplicity of selection and ease of synthesis. Extensive research therefore has been dedicated in this respect and organic charge transport materials have been becoming more important among present charge transport materials.

Organic photoreceptor may be produced by selecting suitable charge generation material, charge transport material and polymeric binders. A simple process with high productivity can be employed. However, conventional organic photoreceptors suffer from some disadvantages such as low sensitivity, high residual surface potential and bad reproducibility after repeated uses. The improvement of the these properties have always been sought after.

SUMMARY OF THE INVENTION

Accordingly, it is thus an object of the present invention to provide an organic photoreceptor with high sensitivity, low residual surface potential, good durability and reproducibility (that the residual potential will not accumulate after repeated use).

In accordance with the above object, the subject invention provides an electrophotoreceptor comprising the components of:

an electrically conductive substrate;

a charge generation layer; and a charge transport layer comprising a polymeric binder and a charge transport material, wherein the polymeric binder is a copolymer of styrene and maleic anhydride.

DETAILED DESCRIPTION OF THE INVENTION

It was unexpectedly found that high sensitivity, low residual potential and excellent durability can be realized on a electrophotoreceptor by employing a copolymer of styrene and maleic anhydride as the polymeric binder for the charge transport material.

The copolymer contemplated by the present invention may be represented by the structural formula (I)

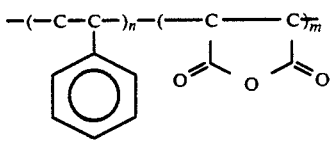

(I)

having a weight average molecular weight preferably from 10,000 to 500,00, more preferably from 100,000 to 300,000. The weight ratio of the styrene monomer to the maleic anhydride in the copolymer is preferably from 99:1 to 1:1, more preferably from 99:1 to 80:20.

In the production of an electrophotoreceptor according to the present invention, the conductive substrate is coated with the described charge generation layer and then the charge transport layer. The charge generation layer is applied by coating on the conductive substrate a solution containing a charge generation material and a polymeric binder followed by drying said solution. A charge transport layer is then applied over the charge generation layer by coating a solution of the above described hydrazone in another polymeric binder and then drying the solution. The coating can be effected by any conventional methods such as blade coating, dipping and spraying.

The dry film thickness of the charge generation layer is generally from 0.01 to 5 um, preferably from 0.04 to 2 um. The dry film thickness of the charge transport layer is generally from 3 to 50 um, preferably from 10 to 25 um. The amount of the polymeric binder in the charge transport layer is from 10 wt % to 95 wt %, preferably from 30 wt % to 80 wt %.

The charge generation materials that may be used in the charge generation layer of the present invention are, for example, inorganic pigments such as selenium, selenium-tellurium alloy, selenium-arsenic alloy and cadmium sulfide, and organic pigments such as phthalocyanine pigment, perinone pigment, thioindigo pigment, quinacridone pigment, perylene pigment, anthraquinone pigment azo pigment, bisazo pigment, cyanine pigment and squaraine pigment.

Charge transport materials suitable for use in the present invention may be either a electron transport material or a hole transport material.

Electron transport material suitable for use as the charge transport material in the present invention include, for example, chloranil, bromanil, tetracyanoethylene, 2,4,7-trinitro-9-flurenone, tetracyanoquino dimethane, 2,4,5,7-tetranitro-9-fluorenone, 2,4,7-trinitro-9-dicyanomethylene-fluoreone, 2,4,5,7-tetranitroxanthone and polymers thereof.

Hole transport material suitable for use as the charge transport material in the present invention include, for example, pyrene, N-ethyl-carbazole, N-isopropyl carbazole, hydrazone compounds such as p-diethylaminobenzaldehyde-N,N-diphenyl hydrazone, N-methyl-N-phenyl-3-methylidene-9-ethyl carbazole and N,N-diphenyl-3-methylidene-9-ethyl carbazole, 2,5-bis-(p-diethylaminophenyl)-1,3,4-oxadiazole, pyrazoline, oxazoles such 2-(p-diethylaminophenyl)-4-dimethylamino-5-(2-chlorophenyl)oxazole, diaryl alkanes such as 1,1-bis(p-diethylaminophenyl)propane, triphenylamine and poly-N-vinyl carbazole.

In a further preferred embodiment, a adhesive layer may be introduced between the conductive substrate and the charge generation layer to prevent the reverse injection of electrons from the conductive support into the charge generation layer. Materials suitable for use as such adhesive are, for example, polyamides, polyvinyl alcohol, casein, nitro cellulose and methyl cellulose. The thickness of the adhesive layer is generally from 1 to 5 um.

If necessary, a plasticizer may be added in charge transport layer to improve its film forming ability. The plasticizers suitable for use in the present invention include, for example, phthalic acid ester, epoxy compounds, chlorinate paraffin, methylnaphthalene.

The styrene-maleic anhydride copolymer selected by the present invention possesses high transparency, high hardness and high compatibility with most charge transport materials. The charge transport layer made therefrom therefore have high durability and, most important of all, possesses high transparency which improves the transmission of incident light through the charge transport layer and renders complete absorption of incident light by the charge generation layer. With this outstanding property, the electrophotoreceptor made in accordance with the present invention is imparted with high sensitivity and low residual potential. Furthermore, stable reproducibility can be obtained without accumulation in residual potential even after long-term repeated use.

The following examples are offered to aid in understanding of the present invention and are not to be construed as limiting the scope thereof.

EXAMPLES

EXAMPLE 1

A binder mixture containing 10 g of a polyamide copolymer (CM8000 available from Toray Co., Japan), 60 g of methanol and 40 g of n-butanol is dip-coated on a aluminium plate of 0.2 mm thickness. The coating was then dried by heating in a hot air oven for 30 minutes. An adhesive layer of 1.0 g/m$^2$ thickness was obtained.

A charge generation layer coating containing 0.68 g of epsilon-type copper phthalocyanine (Heleigen Blue L0700 available from BASF), 0.068 g of hydroxy squaraine (HOSq) of the formula

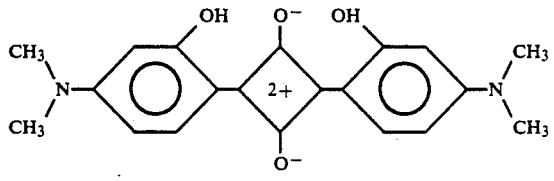

0.75 g polyvinyl butyral (BM2 available from Sekisui Co., Japan), 24.25 g of cyclohexanone and 24.25 g of butanone was mixed by a micronizing mill (product of McCrone, United Kingdom) for 6 hours. The resultant coating was then applied by dipping on the adhesive layer and dried by heating in a hot air oven at 80° C. for 30 minutes. A charge generation layer of 0.3 g/m$^2$ thickness was obtained.

A charge transport layer coating solution containing 0.5 g of a hydrazone compound of the formula:

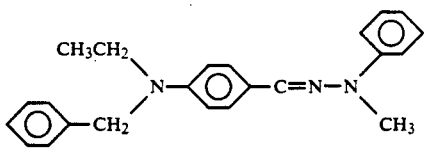

0.75 g of a styrene-maleic anhydride copolymer (Dylark 232 available from Arco Co., Japan), and 4 g of toluene as the solvent was coated on the charge generation layer and then dried by heating in a hot oven of 100° C. for 60 minutes. A charge transport layer of 20 um was obtained.

The resultant organic photoreceptor was tested by Electrostatic Paper Analyzer Model EPA-8100 manufactured by Kawaguchi Electric, Japan to determine its photoconductivity. The corona charge was set at −5.0 kV and the corona charge speed was set at 5 m/min. The initial surface potential on the sample was recorded as $V_0$. After 10 seconds of dark decay, the surface potential was recorded as $V_{10}$. The sample was then exposed under a tungsten light source of 5 Lux intensity and the surface potential began to attenuate. The light energy consumed until the surface potential dropped to a half of $V_{10}$ (half decay exposure) was calculated and recorded as $E_{\frac{1}{2}}$ (in Lux.sec). The residual potential after tungsten exposure was recorded as $V_R$. The following results were obtained:

$V_o$=850 Volt; $E_{\frac{1}{2}}$=1.5 Lux.sec; $V_R$=10 Volt.

EXAMPLE 2

The procedure and conditions of Example 1 were followed, but the hydrazone compound was replaced by the hydrazone compound of the formula

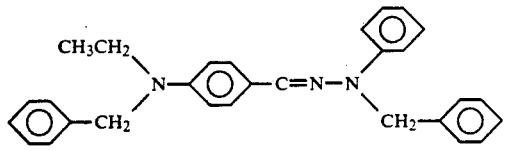

The results were:
$V_o$=1060 Volt; $E_{\frac{1}{2}}$=1.0 Lux.sec; $V_R$=O V.
After 400 times of repeated tests, the following results were obtained:
$V_o$=970 Volt; $E_{\frac{1}{2}}$=1.0 Lux.sec; $V_R$=0 Volt.

EXAMPLE 3

The procedure and conditions of Example 1 were followed, but the hydrazone compound was replaced by the hydrazone compound of the formula:

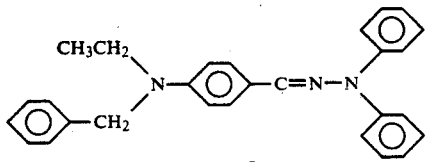

and tetrahydrofuran was used as the solvent instead of toluene.
The results were:
$V_o$=920 Volt; $E_{\frac{1}{2}}$=1.0 Lux.sec; $V_R$=0 Volt.

EXAMPLE 4

The procedure and conditions of Example 2 were followed, but chlorodiane blue was used as the charge generation material instead of copper phthalocyanine and hydroxy squaraine.
The results were:
$V_o$=935 Volt; $E_{\frac{1}{2}}$=6 Lux.sec; $V_R$=5 Volt.

EXAMPLE 5

The procedure and conditions of Example 4 were followed, but the aluminium chloride phthalocyanine (AlClPc) was used as the charge transport material instead of chlorodiane blue.
The results were:
$V_o$=990 Volt; $E_{\frac{1}{2}}$=3.0 Lux.sec; $V_R$=0 Volt.

EXAMPLE 6

The procedure and conditions of Example 4 were followed, but the compound of the formula:

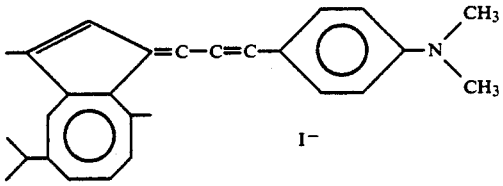

was used as the charge generation material instead of chlorodiane blue.
The results were:
$V_o$=1000 Volt; $E_{\frac{1}{2}}$=1.5 Lux.sec; $V_R$=15 Volt.

EXAMPLE 7

The procedure and conditions of Example 4 were followed, but the charge transport layer coating was replaced by a solution of 0.25 g of hydroxy squaraine, 0.25 g of polyvinly butyral (BM2 available from Sekisui Co., Japan) and 49.5 g dimethylformamide (DMF).
The results were:
$V_o$=1090 Volt; $E_{\frac{1}{2}}$=1.5 Lux.sec; $V_R$=15 Volt.

EXAMPLE 8

The procedure and conditions of Example 7 were followed, but the charge transport material was replaced by the compound of the formula:

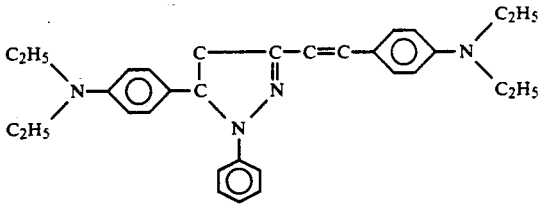

The results were:
$V_o$=725 Volt; $E_{\frac{1}{2}}$=2.5 Lux.sec; $V_R$=0 Volt.

COMPARATIVE EXAMPLE 1

The same procedure and conditions of Example 3 were followed but the polymeric binder was replaced a styrene-methyl methacrylate copolymer (MS200 available from Seitetsu Chemical, Japan). The solvent was replaced by a 1:2 mixture of toluene and tetrahydrofuran.
The results were:
$V_o$=940 Volt; $E_{\frac{1}{2}}$=2.0 Lux.sec; $V_R$=60 Volt.
After 100 times of repeated test, the residual potential $V_R$ increased to 225 Volt.

COMPARATIVE EXAMPLE 2

The same procedure and conditions of Comparative Example 1 were followed but the polymeric binder for the charge transport material was replace by polymethyl methacrylate (BR80 available from Mitsubishi Rayon Co., Japan)
The results were:
$V_o$=890 Volt; $E_{\frac{1}{2}}$=2.5 Lux.sec; $V_R$=120 Volt.

COMPARATIVE EXAMPLE 3

The same procedure and conditions of Comparative Example 2 were followed but the polymeric binder for the charge transport material was replace by a phenoxy resin (PKHH available from Union Carbide Co., U.S.A.)
The results were:
$V_o$=800 Volt; $E_{\frac{1}{2}}$=15 Lux.sec; $V_R$=160 Volt.

COMPARATIVE EXAMPLE 4

The same procedure and conditions of Example 7 were followed but the charge transport material was replace by a compound of the formula:

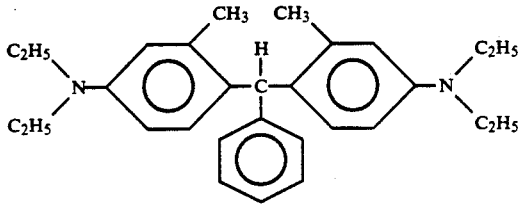

the polymeric binder for the charge transport material was replaced by polymethyl methacrylate (BR80 available from Mitsubishi Rayon Co., Japan), and the solvent was replaced by tetrahydrofuran.

The results were:

$V_o$=1025 Volt; $E_{\frac{1}{2}}$=27.5 Lux.sec; $V_R$=318 Volt.

As shown by the above examples, electrophotoreceptors using styrene-maleic anhydride copolymer as the polymeric binder for the charge transport material possesses improved properties of high sensitivity, low residual surface potential and good durability. The residual surface potential will not accumulate even after long-term repeated use.

While only limited embodiments of the present invention have been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

I claim:

1. An electrophotoreceptor comprising:

an electrically conductive substrate;

a charge generation layer, coated on said electrically conductive substrate, comprising a charge generation material selected from the group consisting of phthalocyanine pigment, bisazo pigment and squaraine pigment; and a charge transport layer, coated over said charge generation layer, comprising a polymeric binder and a charge transport material, said polymeric binder being a copolymer of styrene and maleic anhydride, said copolymer characterized by a weight average molecular weight of from 100,000 to 300,000 and a styrene to maleic anhydride weight ratio in the range of between 99:1 and 80:20, and said charge transport material selected from the group consisting of hydrazone and pyrazoline.

2. The electrophotoreceptor according to claim 1, wherein said charge generation material is selected from the group consisting of phthalocyanine pigment and squaraine pigment.

3. The electrophotoreceptor according to claim 1, wherein said charge transport material is selected from the group of consisting of the compounds represented by the following formulae:

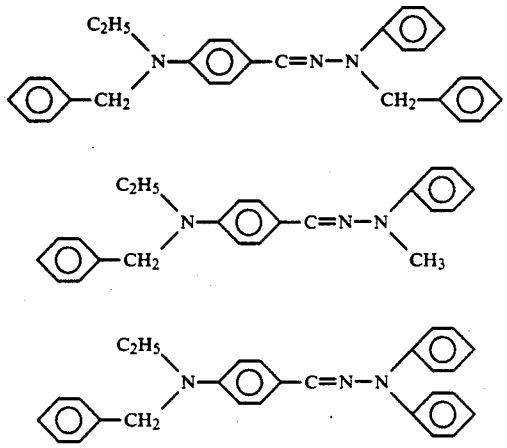

* * * * *